United States Patent [19]

Bohnenberger

[11] 4,199,313

[45] Apr. 22, 1980

[54] DETACHABLE ALIGNING PIN FOR DIE ASSEMBLY

[76] Inventor: Ottmar G. Bohnenberger, 455 Bayberry La., Mountainside, N.J. 07092

[21] Appl. No.: 912,086

[22] Filed: Jun. 2, 1978

[51] Int. Cl.[2] ..... B22C 21/10; B28B 7/04

[52] U.S. Cl. ..... 425/408; 164/385; 164/387; 164/388; 249/160; 249/205; 425/395; 425/542

[58] Field of Search ..... 249/205, 160, 161, 162, 249/165, 166; 425/183, 186, 555, 408; 164/385, 386, 387, 388

[56] References Cited

U.S. PATENT DOCUMENTS

| | | | |
|---|---|---|---|
| 2,405,825 | 8/1946 | Grunow | 164/118 |
| 2,749,987 | 6/1956 | Janiszewski | 308/5 R |
| 3,030,677 | 4/1962 | Kindt et al. | 164/385 |
| 3,379,239 | 4/1968 | Rusk et al. | 164/387 |
| 4,052,033 | 10/1977 | Taylor | 249/205 |

*Primary Examiner*—Murray Tillman
*Assistant Examiner*—A. H. Koeckert
*Attorney, Agent, or Firm*—Lerner, David, Littenberg & Samuel

[57] ABSTRACT

A die assembly includes relatively movable first and second dies, and a plurality of guide pin assemblies mounted on the first die and an equal plurality of aligning passageways formed in the second die for receiving the respective guide pin assemblies. Each of the guide pin assemblies includes a first section mounted within the first die, and a second aligning pin section connected to the first section. Each aligning pin section extends above the surface of the first die for entering one of the plurality of aligning passageways for aligning the first and second dies. Each aligning pin section is detachably connected to a first section and is detached after the first and second dies have been aligned and are ready to be used. In this manner, when the first and second dies are differentially heated during use, the problem of scoring or damaging the aligning pin sections is avoided. In an alternative embodiment, replacement aligning pin sections may be substituted for the original aligning pin sections, with the replacement aligning pin sections including through holes having a central longitudinal axis offset from the central longitudinal axis of the pin section to compensate for uneven expansion of the first and second dies.

8 Claims, 5 Drawing Figures

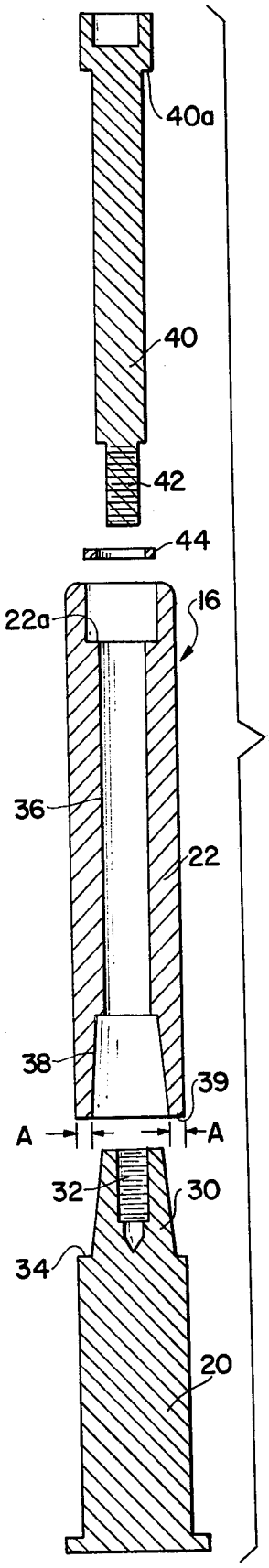
FIG.3
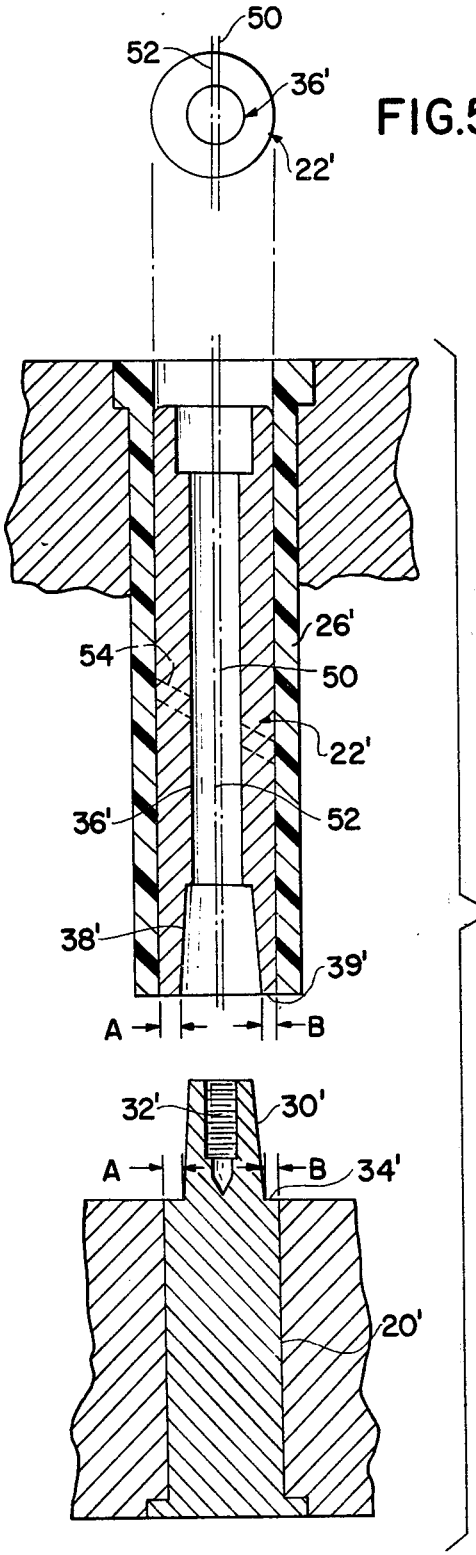
FIG.5
FIG.4

DETACHABLE ALIGNING PIN FOR DIE ASSEMBLY

FIELD OF THE INVENTION

The present invention relates generally to guide pin assemblies for dies for properly aligning a pair of relatively movable dies, and specifically to an improved arrangement, wherein the aligning pin section of each guide pin assembly is removed after the dies have been aligned to avoid any misalignment problems caused by differential heating of the dies during use.

BACKGROUND OF THE INVENTION

In the molding art, including injection molding, die cast molding, rubber molding, or the like, typically a pair of relatively movable first and second dies are employed to mold a desired object. However, before the die assembly may be operated, there must be assurance that the dies are properly aligned relative to each other. In order to accomplish this, guide pins have been typically employed in the past. Usually, the guide pins are mounted within one of the dies, and each includes a portion extending above the surface of the die for entering one of a plurality of aligning passageways formed in the other die for receiving the respective guide pins to align the dies.

However, the problem with such an arrangement is that when the die assembly is operated to mold a desired object, typically the two die sections of the die assembly are heated to different temperatures so that there is a differential expansion problem. This causes one of the die sections of the die assembly to expand to a greater extent than the other die section, so that the aligning passageways on one die are moved out of alignment with the guide pins of the other die. As a result, during subsequent molding operations of the die assembly, because the guide pins are no longer properly aligned with the aligning passageways, the guide pins and/or passageways are damaged or scored. Accordingly, it would be desirable to provide an arrangement which overcomes these problems.

Broadly, it is an object of the present invention to provide an improved guide pin assembly for dies which overcomes the aforesaid problems. Specifically, it is within the contemplation of the present invention to provide guide pin assemblies which include detachable aligning pins which may be detached from the guide pin assembly after the dies have been aligned and are ready to be used in order to avoid any problems of scoring and/or damaging the guide pins and/or aligning passageways of the die assembly.

It is a further object of the present invention to provide an arrangement wherein the guide pin assembly is formed in sections so that the section extending above the surface of the first die for entering one of a plurality of aligning passageways of a second die for aligning the first and second dies in detached after the first and second dies have been aligned, so that damage to the guide pins caused by differential heating of the first and second dies is avoided.

It is a still further object of the present invention to provide in an alternative embodiment an arrangement wherein each of the guide pin assemblies includes a detachable aligning pin section which may be replaced with a replacement aligning pin section which includes unsymmetrical wall sections to compensate for uneven expansion of the first and second dies.

SUMMARY OF THE INVENTION

Briefly, in accordance with the principles of the present invention, an improved guide pin assembly for aligning a die assembly has been provided. The die assembly includes relatively movable first and second dies, and a plurality of guide pin assemblies mounted on the first die and an equal plurality of aligning passageways formed on the second die for receiving respective guide pin assemblies to align the first and second dies. Each of the guide pin assemblies includes a first section mounted within the first die and a second aligning pin section connected to the first section. The aligning pin section of each of the guide pin assemblies extends above the surface of the first die for entering one of a plurality of aligning passageways in the second die for aligning the first and second dies. Each of the aligning pin sections is detachably connected to a respective first section, so that each of the aligning pin sections may be detached from its respective first section after the first and second dies have been aligned and are ready to be used.

In a preferred embodiment, the respective first and second sections of the guide pin assemblies are detachably connected by a bolt or the like. In this embodiment, each of the second aligning pin sections includes a through hole through which the bolt extends for connection to the respective first sections,. In addition, each of the first sections includes a tapered head extending above the surface of the first die, and each of the second sections includes a tapered recess formed in the bottom thereof for matingly receiving the tapered head of the first section.

In an alternative embodiment, after the respective aligning pin sections have been removed, they may be replaced with replacement aligning pin sections which include through holes having a central longitudinal axis offset from the central longitudinal axis of the pin section and, therefore, unsymmetrical wall sections, so that when it is replaced in the guide pin assembly, it compensates for the uneven expansion of the first and second dies caused by differential heating of the dies.

BRIEF DESCRIPTION OF THE DRAWINGS

Further objects, features, and advantages of the present invention will become apparent upon the consideration of the following detailed description of presently-preferred embodiments when taken in conjunction with the accompanying drawings, wherein:

FIG. 3 is an exploded sectional view of a disassembled guide pin assembly in accordance with the present invention;

FIG. 4 is a sectional view of a replacement aligning pin section which includes an offset through hole to compensate for uneven expansion of the first and second dies; and FIG. 5 is a cross-sectional view of FIG. 4.

DETAILED DISCUSSION OF PREFERRED EMBODIMENTS OF THE INVENTION

Figure 1:
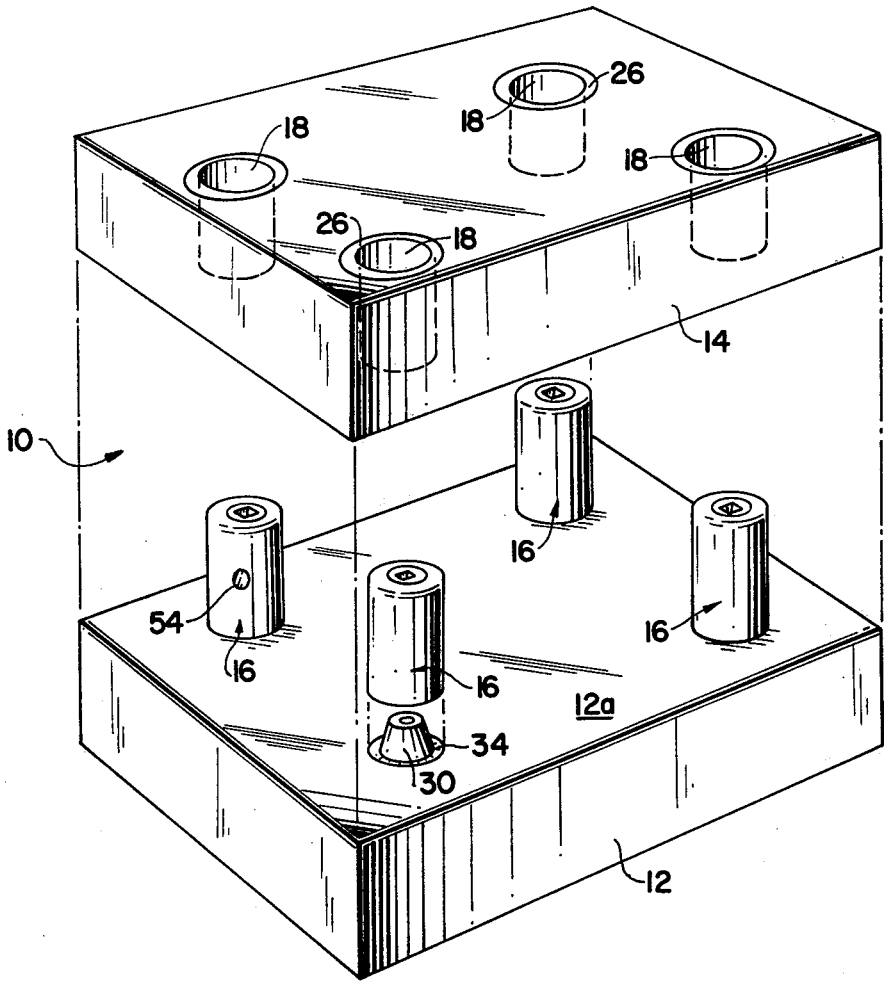
FIG. 1 is a perspective view of the guide pin assemblies of the present invention for use in a typical die assembly.

Referring now to FIG. 1, there is shown the improved die assembly of the present invention, generally designated by the reference numeral 10, which includes a first or lower die 12 and a relatively movable second or upper die 14. The lower die 12 includes a plurality of guide pin assemblies 16 mounted thereon, and upper die 14 includes an equal plurality of aligning passageways 18 for receiving the respective guide pin assemblies 16.

Figure 2:
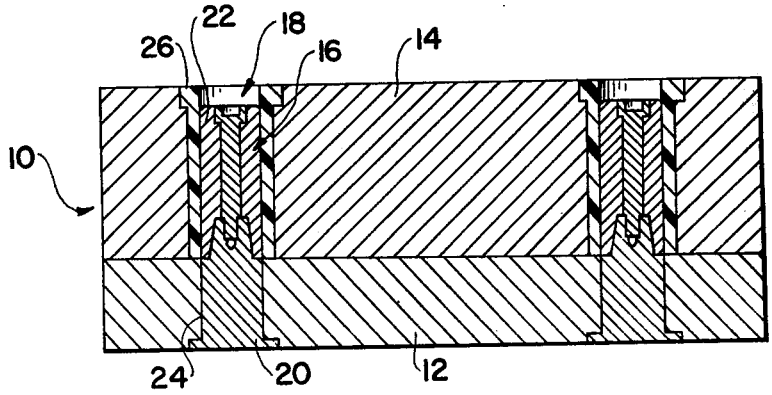
FIG. 2 is a sectional view illustrating the arrangement of the guide pin assemblies of the present invention when the dies are closed.

As shown most clearly in FIG. 2, each of the guide pin assemblies includes a first or a lower section 20 mounted within the lower die 12 and a second aligning pin section 22 connected to the lower section 20. Each of the lower sections 20 is press fit within a suitable opening 24 formed in lower die section 12. In addition, each of the aligning passageways 18 in upper die section 14 includes a sleeve or bushing 26 which lines the passageway 18, if desired. As will be noted, aligning passageways 18 extend completely through the upper die section 14. As will also be understood, the guide pin assemblies 16 can also be on the upper die, with the passageways 18 being on the lower die.

Turning now to FIG. 3, the details of each guide pin assembly 16 are illustrated. As will be seen, the lower section 20 includes a tapered head 30 having a recess 32 formed therein, for a purpose to be explained. At the bottom of tapered head 30, there is an annular plateau 34 extending around the tapered head 30, for a purpose to be explained. As will be noted from FIGS. 1 and 2, when lower section 20 is press fit into hole 24 of lower die 12, the tapered head 30 extends above the surface 12*a* of lower die 12. Returning to FIG. 3, aligning pin section 22 includes a through hole 36 which extends into a tapered recess 38 formed in the bottom of the section for matingly receiving tapered head 30. In addition, each of the guide pin assemblies 16 includes suitable means for detachably connecting sections 20, 22. As shown in FIG. 3, a suitable bolt 40 is provided with threads 42 for passing through a washer 44. In its assembled state, bolt 40 passes through hole 36 of section 22 so that bolt head 40*a* and washer 44 rest on plateau 22*a*, and so that the threaded end 42 of bolt 40 is received within opening 32 formed within tapered head 30. In this manner, all of the elements of the guide pin assembly 16 are secured together, and as will be understood, the annular bottom surface 39 of section 22 will rest on and be secured to plateau 34 of lower section 20.

In operation, the aligning pin sections 22 of each of the guide pin assemblies 16 enter a respective one of the aligning passageways 18 for properly aligning and/or guiding the dies 12, 14 so that they may be operated to perform the desired molding functions, which typically can be injection molding, die-cast molding, rubber molding, or the like. During use of the dies, the upper and lower dies are typically heated to different temperatures, so that one die may expand more than the other die. As a result, the guide pin assemblies 16 will no longer be in complete alignment with their associated aligning passageways 18. If the die assembly was operated in this condition, not only would the upper and lower dies be knocked out of alignment, but the aligning pin sections 22 would not enter their associated aligning passageways 18, or if they did, the passageways and/or the aligning pin sections 16 would be scored and/or damaged.

As a result of the present invention, each of the aligning pin sections 18 has been made detachable in order to avoid this problem. Accordingly, after dies 12, 14 are properly aligned, the upper aligning pin sections 22 are removed from each of the guide pin assemblies 16. This is accomplished by simply unthreading bolt 40 so that each upper section 22 may be removed from its associated lower section 20. As a result, as shown in FIG. 1, only the tapered head 30 extends above the surface 12*a* of lower die 12. Since there is a plateau 34 extending around the head 30, even if the head 30 has expanded and shifted with respect to its associated aligning passageway 18, such shift would not be great enough for tapered head 30 to engage the walls of passageway 18. Accordingly, as a result of the present invention, by having upper section 22 detachably removable from lower section 20 after alignment, dies 12, 14 may be operated at differential temperatures, and there is no problem of misaligning the dies, or scoring or damaging the guide pin assemblies or their associated aligning passageways.

Referring now to FIG. 4, an alternative embodiment of the present invention is illustrated. Under certain circumstances, after the upper aligning pin section 22 has been removed, it may still be desirable to employ some means to maintain the lower and upper dies 12, 14 in their accurately aligned state during operation. In the present invention, this is accomplished by replacing the detached aligning pin section 22 with a substitute or replacement aligning pin section 22'.

As will be noted from FIG. 4, aligning pin section 22' also includes a through hole 36' for receiving a bolt or the like extending therethrough and is also provided with a tapered recess 38' formed in the bottom thereof for matingly receiving a tapered head 30' having a recess 32' formed therein for receiving the end of the bolt or the like. In addition, replacement aligning pin section 22' includes an annular bottom surface 39' for resting on and engaging plateau 34'. Accordingly, replacement aligning pin section 22' is substantially identical to the removed aligning pin section 22, except that through hole 36' does not extend through the longitudinal center of section 22'. More particularly, the central longitudinal axis 50 of through hole 36' is offset from the central longitudinal axis 52 of section 22'. In this manner, the wall portion on one side of section 22' is thinner than the wall portion on the other side of section 22'. As shown in FIG. 4, the dimension B of annular surface 39' is less than the dimension designated A on the other side of annular surface 39'. Therefore, when section 22' is placed on section 20', section 22' can be rotated to the desired position to compensate for differential expansion between the first and second dies 12, 14.

As will be understood, if upper die 14 expands more than lower die 12, the central axis of each aligning passageway 18 will be shifted away from the center of the die a small degree, for example, one sixty-fourth of an inch. As a result, if the guide pin assemblies 16 are not replaced, they will be out of alignment with their respective shifted aligning passageways 18. In order to avoid this, replacement aligning pin section 22' is substituted for section 22, and the thinner dimension B of annular surface 39' is placed on head section 30' so that the thinner dimension B of section 22' faces the center of the die 12. As a result, since the interior dimension of through hole 36' remains the same, as well as the dimension of recess 38', replacement section 22' still fits on lower section 20' and may still be secured by bolt 40' or the like. However, since the wall dimensions A, B of replacement section 22' have been modified to compensate for the shift in aligning passageway 18', dies 12, 14 may be operated, and replacement aligning pin section 22' will enter the shifted aligning passageway 18' without scoring and/or damaging the dies or the guide pin assemblies or the passageway 18'.

As will be understood, if the lower die 12 is heated to a greater extent than upper die 14 and expands to a greater extent than upper die 14, then the longitudinal central axis of lower section 20' will be shifted to a greater extent than the longitudinal central axis of its associated aligning passageway 18'. As a result, replacement aligning pin section 22' will be placed on lower section 20' in a manner which is 180° reversed to the foregoing example. That is, the thinner wall dimension B would be placed on plateau 34' so that the thinner wall portion of section 22' will be facing away from the center of lower die 12 to compensate for the differential expansion of the lower and upper dies 12, 14.

As seen in FIG. 4, section 22' includes a passageway 54 for receiving a tool for removing section 22' from section 20.

As will also be understood, dies 12, 14 can be formed of any suitable material, such as steel, copper, aluminum, or brass. Also, the dimensions of the thicker and thinner wall portions A and B will change according to the die material used, the dimensions of the die, and the degree of differential heating between the upper and lower dies. It is also understood that guide pin assemblies 16 are preferably formed of steel, although other suitable materials may be used.

In view of the foregoing, it will be appreciated that there has been provided in accordance with the present invention improved guide pin assemblies which include detachable sections which are detachable after alignment of the dies so as to avoid any damage to the guide pin assemblies or dies which may be caused by misalignment of the dies brought about by differential heating of the dies. In addition, if it is desired to continually maintain alignment of the upper and lower dies during the molding operations, replacement aligning pin sections may be employed which are constructed and arranged on the lower sections of the guide pin assemblies to compensate for uneven expansion of the dies.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. In a die assembly, an improved aligning pin arrangement, comprising:

relatively movable first and second dies, a plurality of guide pin assemblies on said first die and an equal plurality of aligning passageways formed on said second die for receiving respective ones of said guide pin assemblies, each of said guide pin assemblies including a first section mounted within said first die and a second aligning pin section connected to said first section, said second aligning pin sections extending above the surface of said first die and having an outer configuration substantially equal to the inner configuration of said aligning passageways for entering an associated one of said plurality of aligning passageways for aligning said first and second dies, and each of said second aligning pin sections being detachably connected to a respective first section and including a through hole and means extending therethrough for engaging said respective first sections and securing said respective second aligning pin sections thereto, so that each of said second aligning pin sections may be detached from its respective first section after said first and second dies have been aligned and are ready to be used.

2. A die assembly in accordance with claim 1, wherein each of said first sections and second aligning pin sections are detachably connected by bolt means extending through said through hole.

3. A die assembly in accordance with claim 1, wherein each of said first sections includes a tapered head extending above the surface of said first die, and wherein each of said second aligning pin sections includes a tapered recess formed in the bottom thereof for matingly receiving said tapered head.

4. In a die assembly, an improved aligning pin arrangement, comprising:

relatively movable first and second dies, a plurality of guide pin assemblies mounted on said first die and an equal plurality of aligning passageways formed in said second die for receiving associated ones of said guide pin assemblies to align said first and second dies, each of said guide pin assemblies including a first section mounted within said first die and a second aligning pin section connected to said first section, said second aligning pin sections extending above the surface of said first die for entering an associated one of said plurality of aligning passageways in said second die for aligning said first and second dies, each of said second aligning sections being detachably connected to a respective first section so that each of said second aligning pin sections may be detached from its respective first section after said first and second dies have been aligned, and a plurality of replacement second sections for replacing said detached aligning pin sections, each of said replacement sections having an outer annular wall including oppositely disposed first and second circumferential portions, said first circumferential portion of the outer wall of each of said replacement second sections having a larger radial dimension than the radial dimension of said second circumferential portion of said outer wall to compensate for uneven expansion of said first and second dies.

5. A die assembly in accordance with claim 4, wherein said respective first and second sections are detachably connected by bolt means and wherein said respective first sections and replacement sections are detachably connected by said bolt means.

6. A die assembly in accordance with claim 5, wherein each of said second aligning pin sections and each of said replacement sections includes a through hole through which said bolt means extends for engaging said respective first sections.

7. A die assembly in accordance with claim 4, wherein each of said first sections includes a tapered head extending above the surface of said first die and wherein each of said second sections and each of said replacement sections includes a tapered recess formed at the bottom thereof for matingly receiving said tapered head of an associated first section.

8. A die assembly in accordance with claim 6, wherein the through holes of each of said replacement sections includes a central longitudinal axis offset from the central longitudinal axis of said replacement sections.

* * * * *